US009380838B2

(12) United States Patent
Iannello et al.

(10) Patent No.: US 9,380,838 B2
(45) Date of Patent: Jul. 5, 2016

(54) OVER MOLDED G-HOOK

(71) Applicant: ILLINOIS TOOL WORKS INC., Glenview, IL (US)

(72) Inventors: Christopher A. J. Iannello, Rolling Meadows, IL (US); Martin J. Nilsen, Hampshire, IL (US); Craig E. Ernst, Jr., Marlboro, NY (US)

(73) Assignee: Illinois Tool Works Inc., Glenview, IL (US)

( * ) Notice: Subject to any disclaimer, the term of this patent is extended or adjusted under 35 U.S.C. 154(b) by 160 days.

(21) Appl. No.: 14/370,219

(22) PCT Filed: Jan. 8, 2013

(86) PCT No.: PCT/US2013/020614
§ 371 (c)(1),
(2) Date: Jul. 2, 2014

(87) PCT Pub. No.: WO2013/106296
PCT Pub. Date: Jul. 18, 2013

(65) Prior Publication Data

US 2014/0338157 A1 Nov. 20, 2014

Related U.S. Application Data

(60) Provisional application No. 61/584,512, filed on Jan. 9, 2012.

(51) Int. Cl.

| | |
|---|---|
| ***A44B 13/00*** | (2006.01) |
| ***A45F 5/00*** | (2006.01) |
| ***A45F 5/02*** | (2006.01) |
| ***A44B 11/04*** | (2006.01) |
| *A45F 3/14* | (2006.01) |

(52) U.S. Cl.
CPC ..... *A44B 13/0029* (2013.01); *A44B 11/04* (2013.01); *A44B 13/0023* (2013.01); *A45F 5/00* (2013.01); *A45F 5/02* (2013.01); *A44B 13/0005* (2013.01); *A44B 13/0017* (2013.01); *A44B 13/0064* (2013.01); *A44B 13/0094* (2013.01); *A45F 2003/146* (2013.01); *Y10T 24/3416* (2015.01)

(58) Field of Classification Search
CPC ..... A44B 13/0029; A44B 13/0005; A44B 13/0017; A44B 13/0023; A44B 11/04; A44B 13/0064; A44B 13/0094; Y10T 24/3416
See application file for complete search history.

(56) References Cited

U.S. PATENT DOCUMENTS

| | | | | |
|---|---|---|---|---|
| 779,279 | A * | 1/1905 | Hastings | A44B 11/04 24/200 |
| 2,293,562 | A * | 8/1942 | Rosenthal | A44B 11/04 24/200 |
| 5,432,985 | A | 7/1995 | Bernart | |
| 6,715,186 | B1 | 4/2004 | Huang | |
| D666,526 | S * | 9/2012 | Iannello | D11/210 |
| D666,942 | S * | 9/2012 | Iannello | D11/210 |
| 2008/0155792 | A1 | 7/2008 | Yeh | |
| 2011/0137336 | A1 | 6/2011 | Holcomb et al. | |

FOREIGN PATENT DOCUMENTS

| | | | |
|---|---|---|---|
| DE | 10342712 | A1 | 4/2005 |
| FR | 1078577 | A | 11/1954 |
| WO | 95/09547 | A1 | 4/1995 |
| WO | 2010081417 | A1 | 7/2010 |

OTHER PUBLICATIONS

ISR and WO for PCT/US2013/020614 mailed May 28, 2013.

* cited by examiner

*Primary Examiner* — Robert J Sandy
*Assistant Examiner* — Michael Lee

(57) ABSTRACT

A loop engaging G-hook with a metal interior having a polymer covering. The metal interior remains uncovered in selected regions which engage the connection strap and loops during use. One uncovered region may be a wave-form cross-bar in a threading eyelet engaging the strap. Another uncovered portion may define an inwardly projecting ridge disposed along the inboard edge of the hooking arm adapted to extend through the loops. The selective combination of bare and covered metal provides a high level of strength in a low profile hook structure.

20 Claims, 9 Drawing Sheets

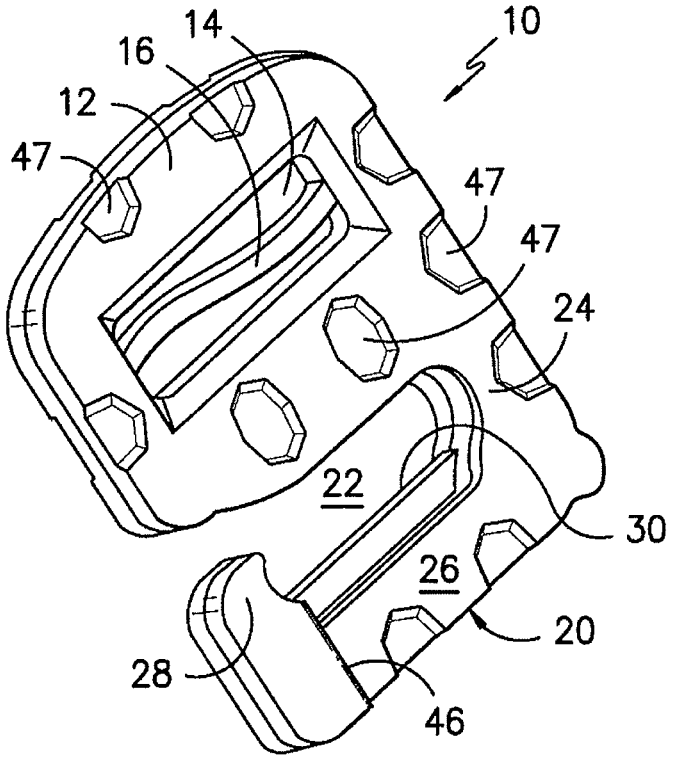
FIG. —1—
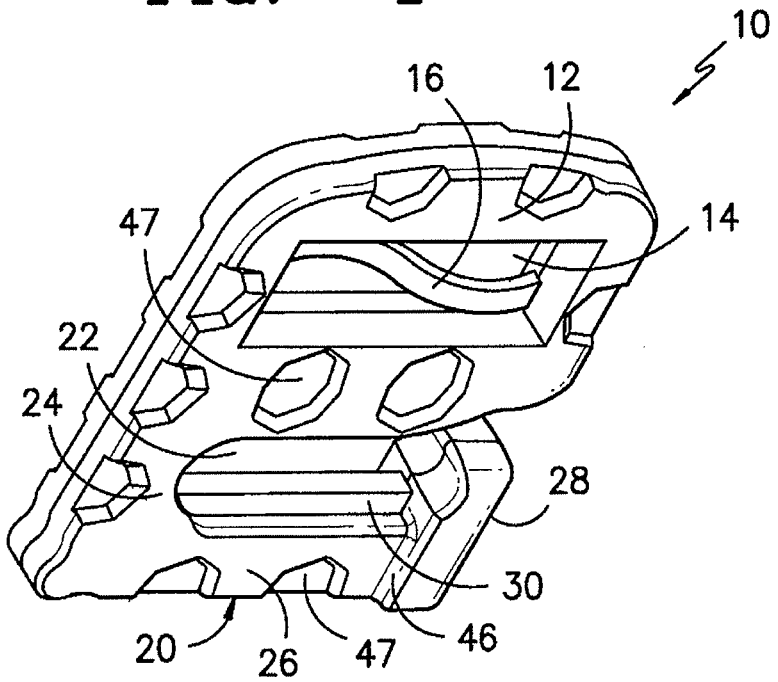
FIG. —2—

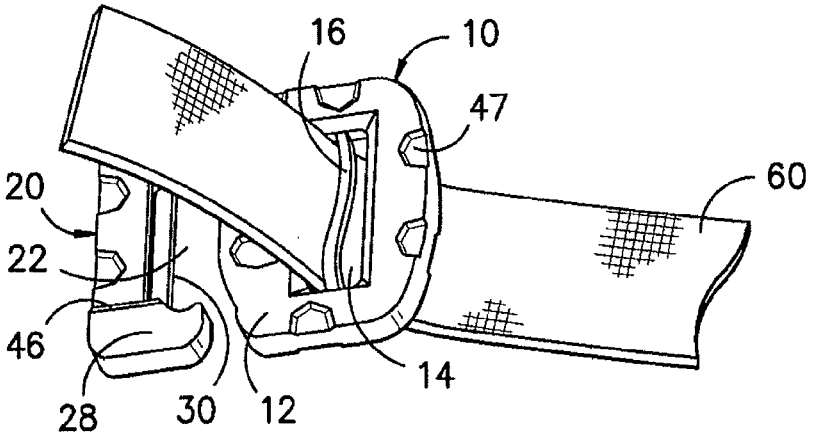
FIG. –5–
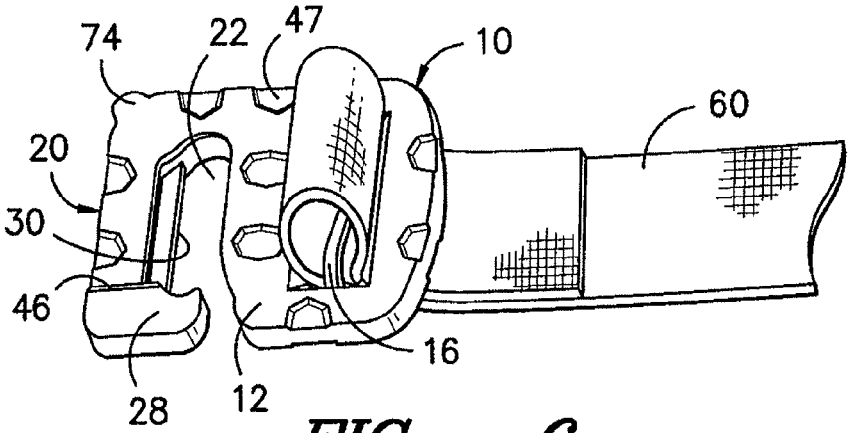
FIG. –6–
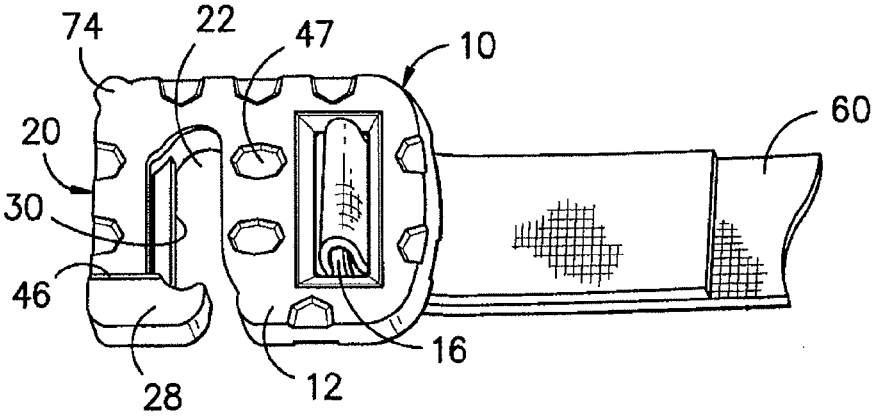
FIG. –7–

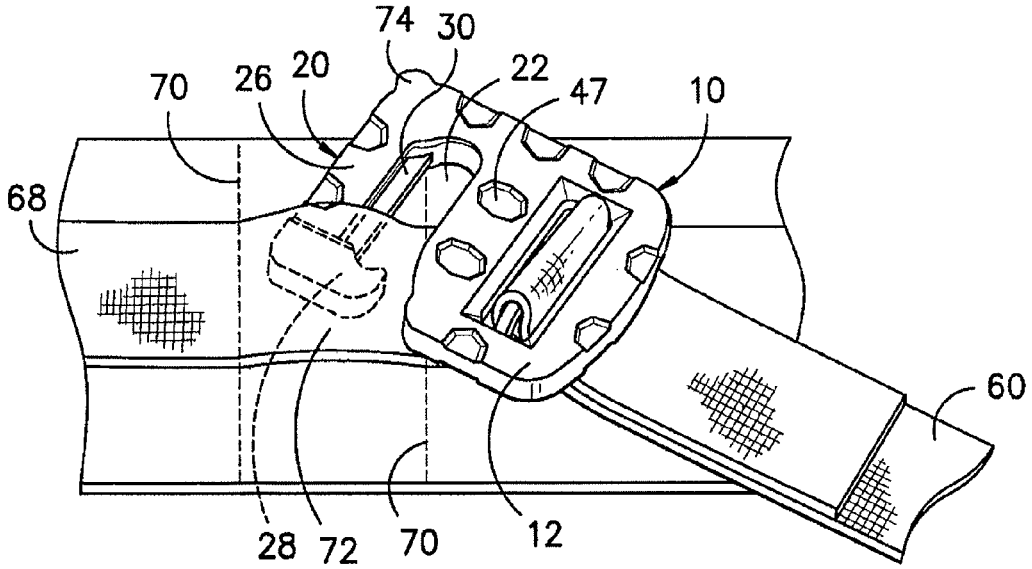
FIG. –9–
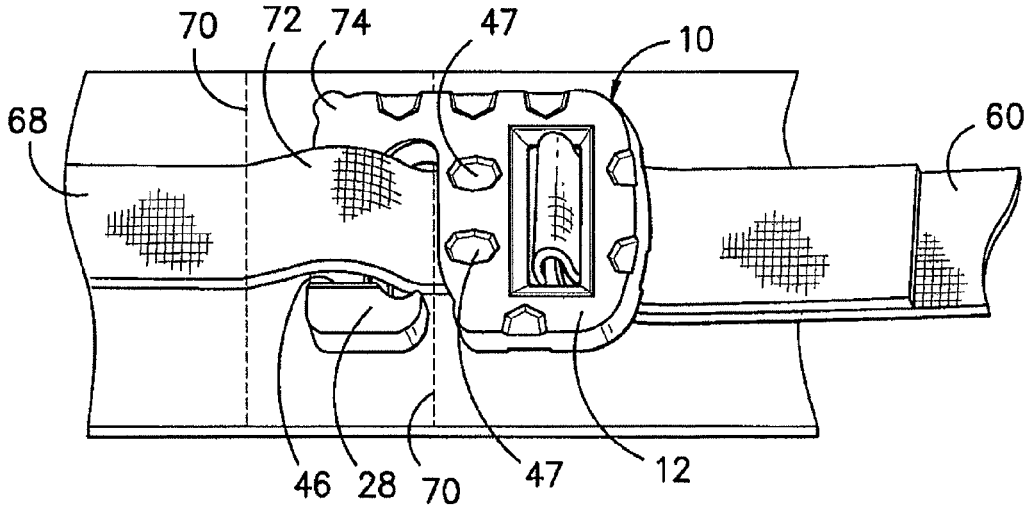
FIG. –10–

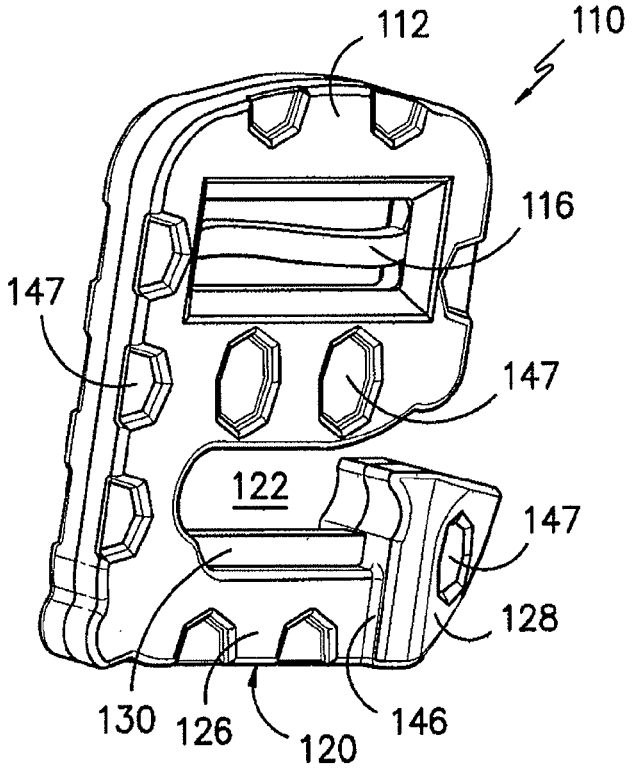
FIG. –12–
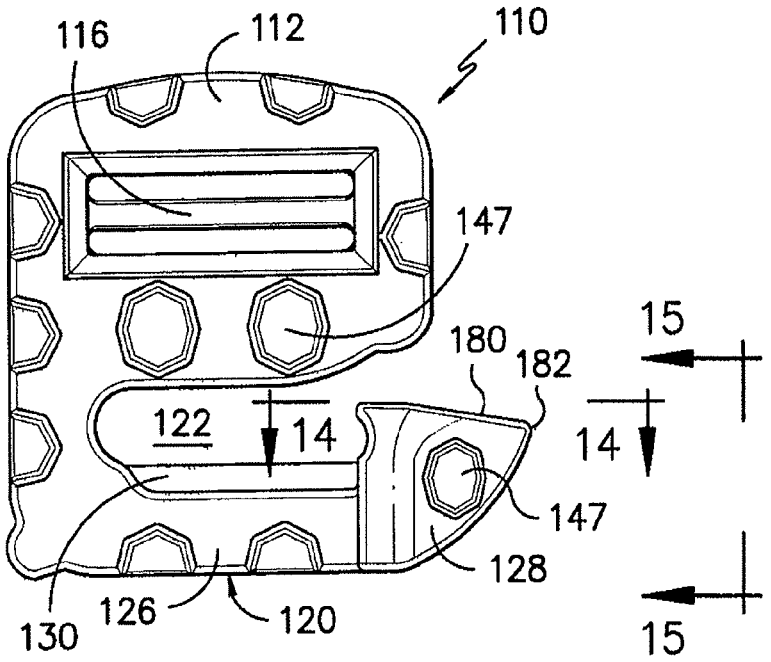
FIG. –13–

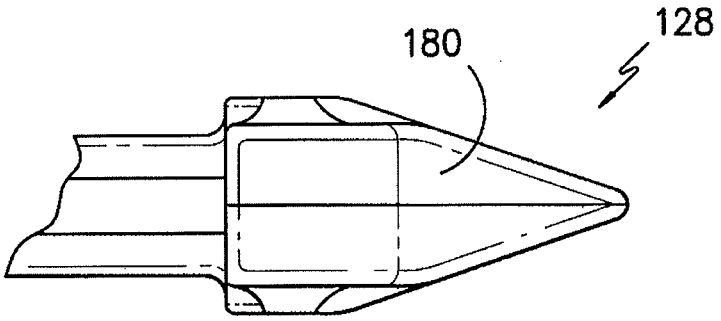
FIG. –14–
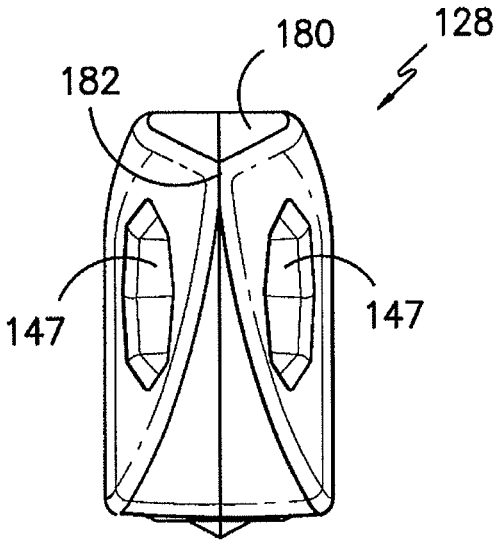
FIG. –15–

OVER MOLDED G-HOOK

CROSS REFERENCE TO RELATED APPLICATIONS

This application is a National Phase of International Application Number PCT/US2013/020614 filed Jan. 8, 2013 and claims the benefit of, and priority from U.S. provisional application 61/584,512 filed Jan. 9, 2012. The contents of such prior provisional application and all other documents referenced in this application are hereby incorporated by reference in their entirety as if fully set forth herein.

TECHNICAL FIELD

The present disclosure relates generally to strap connectors, and more specifically to a G-Hook adapted to accept a threaded strap and to interface with stitched-in webbing loops in a load support system in a claw-like manner to establish an operative connection between the strap and the webbing loops.

BACKGROUND

In many modern backpack systems loads are distributed by use of strap connections running between the pack and a vest or other torso covering structure worn by the user. By cinching the strap connections between the pack and the user's torso, such systems facilitate a more even distribution of load by moving a portion of the load from the user's shoulders and onto the torso and waist. Such load distribution reduces fatigue during prolonged use by allowing a broader group of muscle groups to carry the load. In practice, the straps may be operatively connected to the torso by hooking into loops on so called MOLLE (Modular Light Weight Load Carrying Equipment) webbing. Such MOLLE webbing typically includes a series of open loops formed by stitching the webbing to a vest panel or other support structure at positions along the length of the webbing. The straps from the pack may be attached to hook connectors which engage the loops to establish a reversible connection.

In the past, the hook connectors have been made predominantly from metal to provide adequate strength. However, such metal components may be subject to damage and corrosion, and are more visible when using night vision. Some plastic hook connectors have been used but such structures have been relatively large and bulky in order to provide the desired strength. Moreover, prior plastic parts have been difficult to attach to the connecting strap in a secure manner.

BRIEF SUMMARY

The present disclosure provides advantages and alternatives over the prior art by providing a loop engaging G-hook with a metal interior having a polymer covering. The metal interior remains uncovered in selected regions which engage the connection strap and loops during use. One uncovered region may be a wave-form crossbar in a threading eyelet engaging the strap. Another uncovered portion may define an inwardly projecting ridge disposed along the inboard edge of the hooking arm adapted to extend through the loops. The selective combination of bare and covered metal provides a high level of strength in a low profile structure while securely engaging the strap and loops.

In accordance with one exemplary aspect, the present disclosure provides a G-Hook of multi-layer construction adapted to operatively connect an elongated connection strap to a webbing loop projecting away from an underlying support surface. The G-Hook includes a base portion of substantially planar geometry having an interior eyelet extending through the base portion. The eyelet is adapted to receive the connection strap in pass through relation across the base portion. The G-Hook further includes a hooking arm of generally "J" shaped configuration partially surrounding a loop engagement slot disposed adjacent to the base portion. The hooking arm has a first lateral segment extending away from the base portion, a crossing segment disposed transverse to the first lateral segment and a second lateral segment extending away from the crossing segment in the direction of the base portion. The second lateral segment has a free end spaced apart from the base portion with a space between the free end and the base portion defining a perimeter passage into the loop engagement slot opening. A metal crossbar extends between lateral sides of the eyelet. A metal ridge is disposed along an inboard side of the crossing segment and projects into the loop engagement slot towards the base portion. The crossbar and metal ridge are uncovered portions of a metal insert disposed in embedded, sandwiched relation between a pair of opposing polymeric covering layers.

Other features and advantages of the disclosure will become apparent to those of skill in the art upon review of the following detailed description, claims and drawings.

BRIEF DESCRIPTION OF THE DRAWINGS

FIG. 1 is a schematic perspective view of one embodiment for an exemplary G-hook in accordance with the present disclosure;

FIG. 2 is another schematic perspective view illustrating the reverse side of the exemplary G-hook in FIG. 1;

FIGS. 5-7 are a series of schematic views illustrating threading a strap around a metal wave-form crossbar in a threading eyelet of an exemplary G-hook consistent with FIGS. 1 and 2;

FIGS. 9 and 10 are a set of schematic views illustrating the establishment of a claw-like engagement between the hooking arm of an exemplary G-hook consistent with FIGS. 1 and 2 and a MOLLE loop to provide a secure connection between the MOLLE loop and a threaded strap;

FIG. 12 is a schematic perspective view illustrating another embodiment for an exemplary G-hook in accordance with the present disclosure;

FIG. 13 is a plan view of the exemplary G-hook of FIG. 12.

FIG. 14 is a view taken generally along line 14-14 in FIG. 13; and

FIG. 15 is a view taken generally along line 15-15 in FIG. 13.

Figure 3:
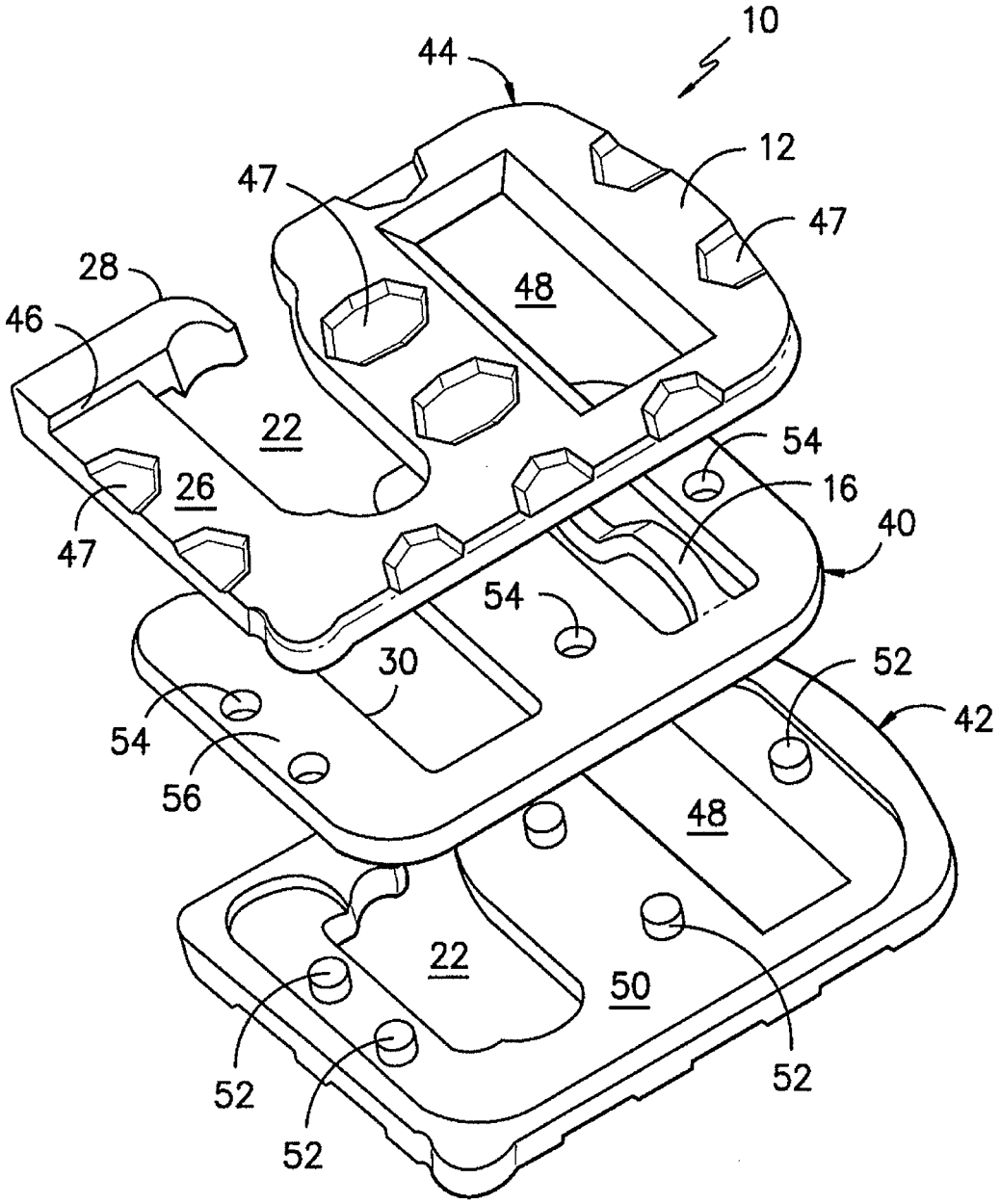
FIG. 3 is a schematic assembly view illustrating the components of an exemplary G-hook consistent with FIGS. 1 and 2.

Before exemplary embodiments of the disclosure are explained in detail, it is to be understood that the disclosure is in no way limited in its application or construction to the details and the arrangements of the components set forth in the following description or illustrated in the drawings.

Rather, the disclosure is capable of other embodiments and being practiced or being carried out in various ways.

DETAILED DESCRIPTION OF PREFERRED EMBODIMENTS

Reference will now be made to figures wherein to the extent possible, like reference numerals are used to designate like elements in the various views. Turning to FIGS. 1 and 2, an exemplary G-hook 10 is shown. As illustrated, the exemplary G-hook 10 includes a base portion 12 of generally rectangular annular construction with rounded corners having an eyelet 14 adapted to receive a strap threaded in a manner as will be described further hereinafter. As shown, the base portion 12 may substantially surround the eyelet 14 such that the eyelet is enclosed on all sides. A crossbar 16 of substantially sine wave construction extends across the eyelet 14. In the exemplary embodiment, the crossbar is uncovered metal and acts to engage the threaded strap in the final connected arrangement. In the illustrated exemplary embodiment, the crossbar 16 defines substantially one complete wave with a maxima peak and a minima peak projecting away from opposite faces of the G-Hook 10. However, other configurations may likewise be used.

In the illustrated exemplary construction, the amplitude of the wave formed by the crossbar 16 is such that both peaks of the wave may extend past the plane defined by the surrounding base portion 12. As will be appreciated, such a configuration with peaks extending beyond the surrounding base portion may facilitate threading a strap between the crossbar 16 and the surrounding base portion 12 in a manner as will be described hereinafter. However it is also contemplated that the total amplitude of the wave may be equal to or less than the thickness dimension of the eyelet 14 and that no portion of the crossbar 16 projects past the plane of the surrounding base portion 12 if desired.

As shown, the exemplary G-Hook 10 further includes a hooking arm denoted generally by reference numeral 20 of generally claw-like, "J" shaped construction extending away from one lateral side of the base portion 12 to define a loop engagement slot 22 below the base portion 12. In the illustrated exemplary construction, the hooking arm 20 may include a first lateral leg 24 connected to a lateral side of the base portion 12 with a crossing segment 26 extending transverse to the first lateral leg 24 and a second lateral leg 28 projecting upwardly from the crossing segment 26 towards the base portion 12. As illustrated, the second lateral leg 28 has a free distal end and does not intersect with the base portion 12. Accordingly, the gap between the base portion 12 and the second lateral leg 28 defines a lateral passageway into the loop engagement slot 22.

In the illustrated exemplary construction, an uncovered metal ridge 30 projects away from the inboard side of the crossing segment 26 and into the loop engagement slot 22 towards the base portion 12. As will be described further hereinafter, the metal ridge 30 may engage the interior of a MOLLE loop during hooking engagement between the G-Hook and the MOLLE loop during use to promote a secure connection.

Figure 4:
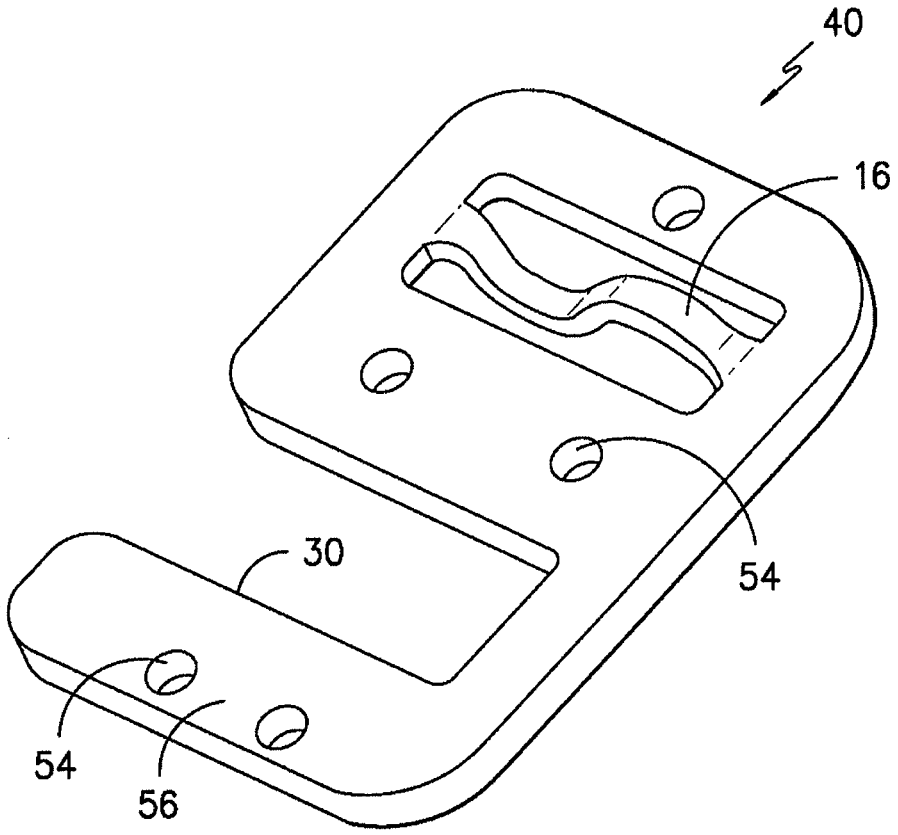
FIG. 4 is a schematic perspective view illustrating an exemplary metal insert used in the assembly practice illustrated in FIG. 3.

As can be best seen through reference to FIGS. 3 and 4, in accordance with the illustrated exemplary construction both the crossbar 16 and the metal ridge 30 are portions of a metal insert 40 of steel or other suitable material. By way of example only, and not limitation, the metal insert 40 may be a one-piece structure formed from relatively light gauge spring steal or the like sandwiched between a first covering layer 42 of one piece construction and a second covering layer 44 of one piece construction. The first covering layer 42 and the second covering layer 44 each may be formed of non-fragmenting polymer configured to substantially cover portions of the metal insert other than the crossbar 16 and the metal ridge 30. In the event of impact, the polymer and metal will not fragment into multiple pieces, but will simply deform or be pierced.

As shown, the first covering layer 42 and the second covering layer 44 may have matching perimeter geometries which each substantially correspond to the desired final perimeter geometry for the assembled G-Hook 10. In the illustrated exemplary construction, the portions the first covering layer 42 and the second covering layer 44 cooperatively forming the second lateral leg 28 may be slightly raised relative to the portions forming the crossing segment 26 so as to define a raised step 46 between the crossing segment 26 and the second lateral leg 28 on one or both faces of the assembled G-Hook (FIG. 2). As will be described, during use, the raised steps 46 may aid in blocking against unintended withdrawal of the G-Hook 10 following loop engagement.

As shown, the first covering layer 42 and the second covering layer 44 may each include a pattern of surface indentations 47 which facilitate gripping by a user without unduly reducing strength. In this regard, the first covering layer 42 and the second covering layer 44 may have either similar or dissimilar surface topography features across their respective faces. Regardless of the surface topography features for the first covering layer 42 and the second covering layer 44, each of these layers includes an enclosed window opening 48 adapted to overlay and receive portions of the crossbar 16 with surrounding space to define the open eyelet 14 with spacing on either side of the crossbar 16 as seen in FIGS. 1 and 2.

As best seen through joint reference to FIGS. 3 and 4, the first covering layer 42 may include a recess 50 having a perimeter geometry substantially matching the outer perimeter of the metal insert 40 such that the metal insert may be received in nesting relation to be at least partially sunken within the recess 50 during assembly or over molding. In accordance with one exemplary practice, to aid in proper positioning and to reduce the possibility of lateral shifting after assembly, the surface of the recess may be provided with a pattern of raised detents 52 positioned for acceptance within aligned openings 54 in the metal insert 40. If desired, a mirror image recess (not shown) may likewise be provided at the interior surface of the second covering layer 44. Regardless of whether the recess is provided at the first covering layer 42, the second covering layer 44 or both, in the final construction the metal insert 40 will be in sufficient sunken relation to permit the outer perimeter ridges of the first covering layer 42 and the second covering layer 44 to be welded or otherwise sealed along a perimeter seam line without interference from the metal insert or over molded plastic over the metal insert. Thus, the metal insert 40 will be in embedded sandwiched relation between the covering layers.

As illustrated, an inboard surface of the metal insert 40 disposed generally parallel to the crossbar 16 forms the uncovered metal ridge 30 in the final construction. In the illustrated exemplary embodiment, the metal insert 40 includes a lower segment 56 positioned generally in embedded juxtaposed relation to segments of the first covering layer 42 and the second covering layer 44 forming the crossing segment 26. However, the height dimension of this lower segment is slightly greater than the height dimension of the overlying portions of the first covering layer 42 and the second covering layer 44. Thus, the uncovered metal ridge 30 projects beyond the boundary of the crossing segment covering layers and into the loop engagement slot 22 in the final construction.

Referring to FIGS. 5-7, an exemplary threading arrangement is illustrated for a connection strap 60. As indicated previously, the connection strap 60 may be connected at its other end to a backpack or other structure (not shown). As illustrated, in the exemplary threading practice the connection strap is threaded through one side of the open eyelet 14 and around the crossbar 16 and back out the other side of the open eyelet 14 to cinch the connection strap 60 in place. Once the cinch connection is made, the connection strap 60 may substantially cover the bare metal of the crossbar 16 (FIG. 7). As will be appreciated, the wave construction of the crossbar 16 may facilitate threading by presenting spaces between the crossbar 16 and the surrounding surface of the base portion 12. Moreover, with the peaks of the waveform crossbar extending beyond the plane of the base portion 12 on both faces, the connection strap 60 may be threaded without regard to the orientation of the G-hook 10. That is, the hooking arm 20 may be either up or down as may be desired for the type of connection to be made by the G-Hook.

Figure 8:
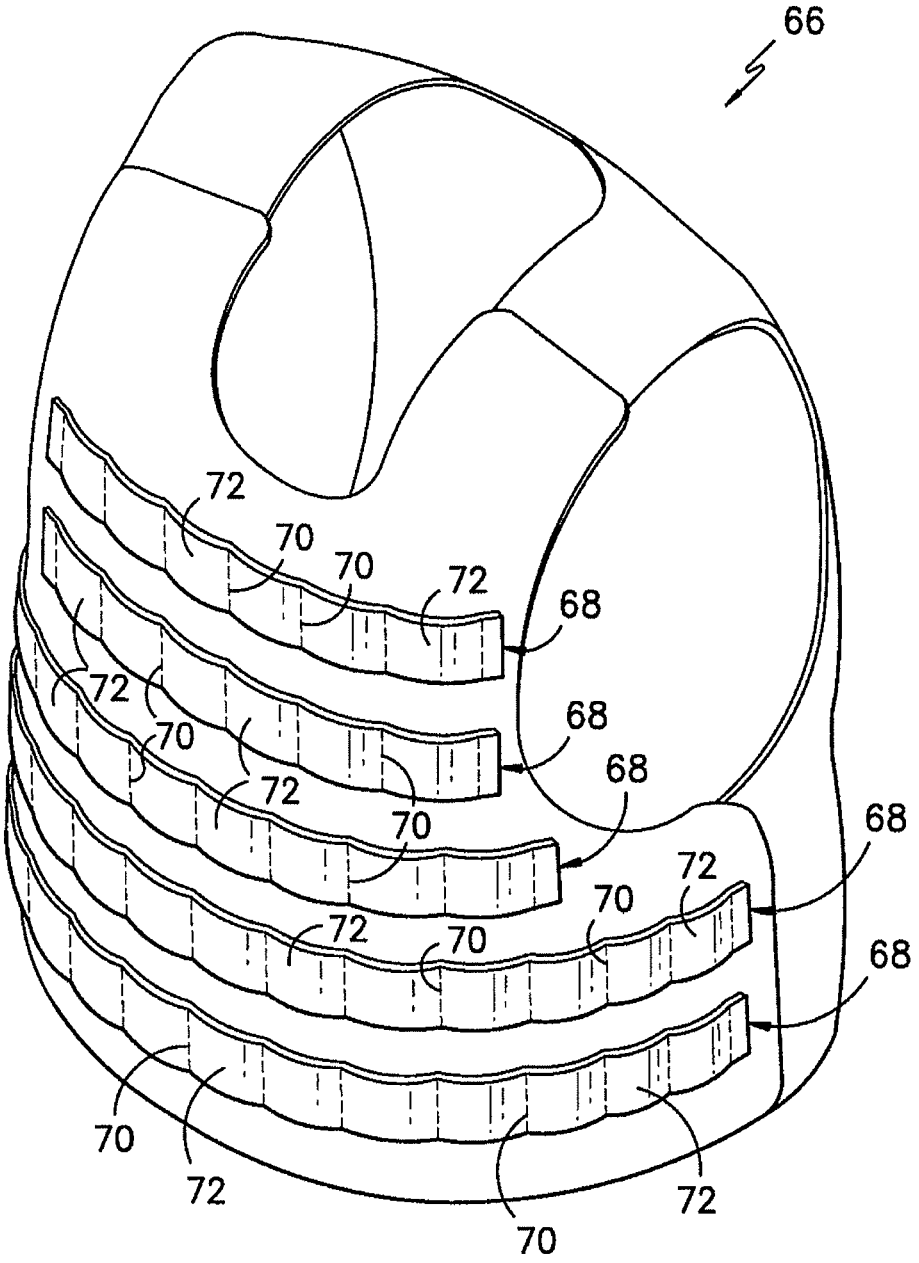
FIG. 8 is a schematic view of an exemplary vest incorporating a MOLLE webbing system suitable for engagement by an exemplary G-hook consistent with FIGS. 1 and 2.

As noted previously, a G-Hook 10 in accordance with the present disclosure may be well suited to operatively engage loops on so called MOLLE (Modular Light Weight Load Carrying Equipment) webbing. By way of example only and not limitation, FIG. 8 is a schematic illustration of a torso covering garment such as a vest 66 or the like as may be worn by a user incorporating a multiplicity of MOLLE webbing loops. In the illustrated exemplary arrangement, the vest 66 includes one or more attached webbings 68. Of course, the number and placement of the webbings 68 is subject to substantial discretion and may be varied as desired depending upon the intended use. As shown, the webbings 68 may include connection elements 70 in the form of connective stitching, mechanical attachments, adhesives or the like attaching the webbings 68 to the surface of the vest 66. The connections may be disposed periodically along the length of the webbings to form a series of loops 72 between the connection elements 70 such that the loops 72 are adapted to matedly receive male elements in pass-through relation. By way of example only, and not limitation, the vest webbings 16 may be formed from segments of elastomeric or inelastic fabric, although other materials as may be desired may likewise be used.

Referring now to FIGS. 9 and 10, the insertion of the hooking arm 20 into a webbing loop 72 is illustrated. As shown, this insertion is accomplished by extending the crossing segment 26 and the second lateral leg 28 of the hooking arm 20 into a loop 72 (FIG. 9). Upon full insertion, the second lateral leg 28 extends through to the far side of the loop 72 and the loop 72 is captured within the loop engagement slot 22. In this condition, the loop 72 rests on the hooking arm and substantially covers the metal ridge 30. Thus, a low profile connection is established. As tension is applied to the connection strap 60, the metal ridge 60 will be pulled towards the opposing connection element 70 and will advance into the naturally occurring crevice between the connection element and the underlying base material of the vest 66 and the raised step 46 is positioned outboard from the ridge of the loop 72. In this final tensioned condition, the raised step 46 will block unintentional withdrawal of the hooking arm from the loop in the absence of intentional manipulation.

In the illustrated exemplary construction, G-Hook 10 also may include an extended finger pull tab 74 at the corner of the hooking arm forming the intersection between the first lateral leg portion 24 and the crossing segment 26. This extended finger pull tab aids a user in grasping the G-hook 10 for tilting manipulation when disengagement is desired.

Figure 11:
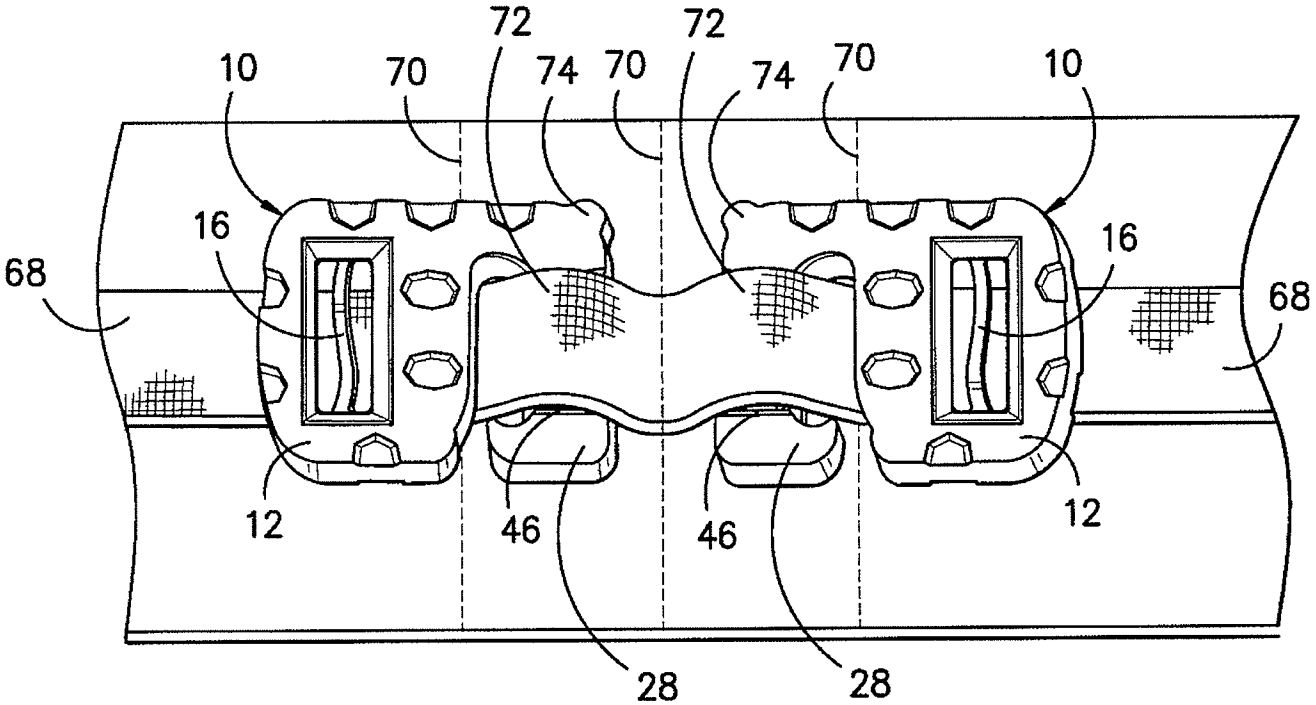
FIG. 11 is a view illustrating left side and right side connections using exemplary G-hooks in accordance with the present disclosure.

As noted previously, the exemplary construction may be used for both left side and right side engagement. This feature is illustrated in FIG. 11 wherein the connection straps have been removed for purposes of visibility. As will be appreciated, the ability to use a common design for both left and right side connections may provide a the user with substantial versatility. In particular, a user may use a single design G-hook 10 to attach straps from both sides of a backpack (not shown) to adjacent loops 72 on a torso covering garment to secure the pack in place in a buckle-like fashion and to distribute a portion of the load away from the user's shoulders.

FIGS. 12 and 13 provide an alternative embodiment for an exemplary G-Hook 110 consistent with the present disclosure, wherein like elements to those described previously are designated by like reference numerals increased by 100. As will be understood, the embodiment of FIGS. 11 and 12 is substantially similar to those previously described with the exception that the second lateral leg 128 defining the free end of the hooking arm defines a generally wedge-shaped beak extending outboard beyond the edge of the base portion 112.

As shown, in the embodiment of FIGS. 12 and 13 the second lateral leg includes a convex curved outboard surface with the second lateral leg 128 having a configuration corresponding generally to that of the bow of a ship with a narrowing width progressing outwardly and downwardly. As best seen through joint reference to FIGS. 13 and 14, in the exemplary G-Hook 110, the second lateral leg 128 has an upper surface 180 which both slopes and narrows to a distal point 182 at the outer edge of the second lateral leg 128. In addition, the front and rear faces of the second lateral leg 128 converge progressively towards one another at the distal point 182. Thus, the second lateral leg is thicker adjacent the crossing segment 126 than at the convex curved outboard surface.

As will be appreciated, the configuration illustrated in FIGS. 12-15 may be beneficial in providing a very low resistance force as the second lateral leg 128 is inserted into a loop as previously described. However, since the second lateral leg 128 is still raised at the intersection with crossing segment 126 to form a raised step 146, a secure blocking arrangement is maintained to prevent unintentional withdrawal.

As will be appreciated, the present disclosure provides a number of advantages. By way of example only these advantages may include, the absence of twisting or reconfiguration to switch sides; improved strength from the metal insert; low profile, secure connection under tension; reduced possibility for fragmentation; and adaptability to fit onto any suitable webbing. Of course, variations and modifications of the foregoing are within the scope of the present disclosure. Thus, it is to be understood that the disclosure disclosed and defined herein extends to all alternative combinations of two or more of the individual features mentioned or evident from the text and/or drawings. All of these different combinations constitute various alternative aspects of the present disclosure.

What is claimed is:

1. A G-Hook of multi-layer construction adapted to operatively connect an elongated connection strap to a webbing loop projecting away from an underlying support surface, the G-Hook comprising:

a base portion of substantially planar geometry, the base portion having an interior eyelet extending through the base portion, the eyelet being adapted to receive the connection strap in pass through relation across the base portion;

a hooking arm partially surrounding a loop engagement slot disposed adjacent to the base portion, the hooking arm having a first lateral segment extending away from the base portion, a crossing segment disposed transverse to the first lateral segment and a second lateral segment extending away from the crossing segment in the direction of the base portion, the second lateral segment having a free end spaced apart from the base portion with a space between the free end and the base portion defining a perimeter passage into the loop engagement slot opening;

a metal crossbar extending between lateral sides of the eyelet; and a metal ridge disposed along an inboard side of the crossing segment and projecting into the loop engagement slot towards the base portion, wherein the crossbar and metal ridge comprise uncovered portions of a metal insert disposed in embedded, sandwiched relation between a pair of opposing polymeric covering layers.

2. The G-Hook as recited in claim 1, wherein the base portion is annular with portions of the base portion enclosing the eyelet.

3. The G-Hook as recited in claim 2, wherein the base portion has a substantially rectangular perimeter.

4. The G-Hook as recited in claim 2, wherein the eyelet is substantially rectangular, and wherein the crossbar extends between lateral sides of the eyelet in substantial alignment with the major dimension of the eyelet.

5. The G-Hook as recited in claim 4, wherein the crossbar has a waveform construction.

6. The G-Hook as recited in claim 5, wherein the crossbar includes a pair of peaks projecting in opposite directions, and wherein the peaks extend in elevated relation to surrounding surfaces of the base portion.

7. The G-Hook as recited in claim 1, wherein the hooking arm and the base portion form a unitary construction.

8. The G-Hook as recited in claim 1, wherein the second lateral segment is elevated relative to the crossing segment defining a step between the second lateral segment and the crossing segment on at least one face of the G-Hook.

9. The G-Hook as recited in claim 1, wherein the second lateral segment is elevated relative to the crossing segment defining a step between the second lateral segment and the crossing segment on both faces of the G-Hook.

10. The G-Hook as recited in claim 1, wherein the metal insert is a unitary construction.

11. The G-Hook as recited in claim 1, wherein the polymeric covering layers are adjoined to one another around the perimeter of the G-Hook in covering relation to the edges of the metal insert.

12. The G-Hook as recited in claim 1, wherein the second lateral segment of the hooking arm is substantially rectangular.

13. The G-Hook as recited in claim 1, wherein the second lateral segment of the hooking arm is substantially wedge shaped with a convex curved outboard surface.

14. The G-Hook as recited in claim 13, wherein the second lateral leg is thicker adjacent the crossing segment than at and the convex curved outboard surface.

15. A G-Hook of multi-layer construction adapted to operatively connect an elongated connection strap to a webbing loop projecting away from an underlying support surface, the G-Hook comprising:

a base portion of substantially planar, annular geometry, the base portion having an interior eyelet extending through the base portion, the eyelet having a perimeter enclosed by surrounding segments of the base portion, the eyelet being adapted to receive the connection strap in pass through relation across the base portion;

a hooking arm integral with the base portion, the hooking arm partially surrounding a loop engagement slot disposed adjacent to the base portion, the hooking arm having a first lateral segment extending away from the base portion, a crossing segment disposed transverse to the first lateral segment and a second lateral segment extending away from the crossing segment in the direction of the base portion, the second lateral segment having a free end spaced apart from the base portion with a space between the free end and the base portion defining a perimeter passage into the loop engagement slot opening, the second lateral segment being elevated relative to the crossing segment defining a step between the second lateral segment and the crossing segment on both faces of the G-Hook;

a metal crossbar of waveform construction extending between lateral sides of the eyelet; and a metal ridge disposed along an inboard side of the crossing segment and projecting into the loop engagement slot towards the base portion, wherein the crossbar and metal ridge comprise uncovered portions of a metal insert disposed in embedded, sandwiched relation between a pair of opposing polymeric covering layers adjoined to one another around the perimeter of the G-Hook in covering relation to the edges of the metal insert.

16. The G-Hook as recited in claim 15, wherein the crossbar includes a pair of peaks projecting in opposite directions, and wherein the peaks extend in elevated relation to surrounding surfaces of the base portion.

17. The G-Hook as recited in claim 15, wherein the second lateral segment of the hooking arm is substantially rectangular.

18. The G-Hook as recited in claim 15, wherein the second lateral segment of the hooking arm is substantially wedge shaped with a convex curved outboard surface.

19. The G-Hook as recited in claim 18, wherein the second lateral leg is thicker adjacent the crossing segment than at and the convex curved outboard surface.

20. A G-Hook of multi-layer construction adapted to operatively connect an elongated connection strap to a webbing loop projecting away from an underlying support surface, the G-Hook comprising:

a base portion of substantially planar, annular geometry, the base portion having an interior eyelet extending through the base portion in a direction transverse to a plane defined by the base portion, the eyelet having a perimeter enclosed by surrounding segments of the base portion, the eyelet being adapted to receive the connection strap in pass through relation across the base portion;

a hooking arm integral with the base portion, the hooking arm partially surrounding a loop engagement slot disposed adjacent to the base portion, the hooking arm having a first lateral segment connected to the base portion, a crossing segment disposed transverse to the first lateral segment and a second lateral segment extending away from the crossing segment in the direction of the base portion, the second lateral segment having a free end spaced apart from the base portion with a space between the free end and the base portion defining a perimeter passage into the loop engagement slot opening, the second lateral segment being elevated relative to the crossing segment defining a step between the second lateral segment and the crossing segment on both faces of the G-Hook;

a metal crossbar of waveform construction extending between lateral sides of the eyelet, the crossbar having peaks extending in raised relation to surfaces of the base portion surrounding the eyelet; and a metal ridge disposed along an inboard side of the crossing segment and projecting into the loop engagement slot towards the base portion, wherein the crossbar and metal ridge comprise uncovered portions of a unitary metal insert disposed in embedded, sandwiched relation between a pair of opposing polymeric covering layers adjoined to one another around the perimeter of the G-Hook in covering relation to the edges of the metal insert, the polymeric covering layers having mirror image perimeter geometries and including window openings oriented for disposition in surrounding relation to the crossbar to define the perimeter of the eyelet in the G-Hook.

* * * * *